US011069960B2

(12) United States Patent
Raj et al.

(10) Patent No.: US 11,069,960 B2
(45) Date of Patent: Jul. 20, 2021

(54) MULTIBAND BASE STATION ANTENNAS HAVING IMPROVED GAIN AND/OR INTERBAND ISOLATION

(71) Applicant: CommScope Technologies LLC, Hickory, NC (US)

(72) Inventors: Tamilarasan Sundara Raj, Kuzhithurai (IN); Krisen James, Thiruvanathapuram (IN); Kumara Swamy Kasani, Godhavarikhani (IN); Lenin Naragani, Hyderabad (IN); Ligang Wu, Suzhou (CN); Ravi Kiran Reddy Tadiparthi, Vasco (IN); Yateen Sutar, Vasco (IN); Venkateswara Rao Polineni, Mormugao (IN); HongHui Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/061,718

(22) Filed: Oct. 2, 2020

(65) Prior Publication Data

US 2021/0111482 A1 Apr. 15, 2021

Related U.S. Application Data

(60) Provisional application No. 62/912,745, filed on Oct. 9, 2019.

(51) Int. Cl.

| | |
|---|---|
| ***H01Q 1/24*** | (2006.01) |
| ***H01Q 5/392*** | (2015.01) |
| ***H01Q 21/06*** | (2006.01) |

(52) U.S. Cl.

CPC ..... *H01Q 1/246* (2013.01); *H01Q 5/392* (2015.01); *H01Q 21/061* (2013.01)

(58) Field of Classification Search

CPC ..... H01Q 1/12; H01Q 1/22; H01Q 1/246; H01Q 5/10; H01Q 5/392; H01Q 21/06; H01Q 21/061; H01Q 21/062; H01Q 21/065; H01Q 21/067; H01Q 21/068; H01Q 21/08

See application file for complete search history.

(56) References Cited

U.S. PATENT DOCUMENTS

2009/0224995 A1* 9/2009 Puente ..... H01Q 9/0457 343/850
2015/0295313 A1* 10/2015 Zimmerman ..... H01Q 1/246 343/810
2018/0227775 A1* 8/2018 Bisiules ..... H01Q 21/08
2018/0337443 A1* 11/2018 Bisiules ..... H01Q 1/42
(Continued)

*Primary Examiner* — Jason Crawford
(74) *Attorney, Agent, or Firm* — Myers Bigel, P.A.

(57) ABSTRACT

Multiband base station antennas include first and second arrays. The first array has a plurality of radiating elements that are arranged in a plurality of columns and rows, where both an uppermost and a lowermost of the rows of the first array include a first number of radiating elements, and at least one of the other rows of the first array includes a second, larger number of radiating elements. The second array includes a plurality of radiating elements that are vertically offset from each other. At least one of the radiating elements in the uppermost of the rows of the first array is not vertically aligned with any of the radiating elements in the lowermost of the rows of the first array.

20 Claims, 6 Drawing Sheets

(56) References Cited

U.S. PATENT DOCUMENTS

| | | | | |
|---|---|---|---|---|
| 2019/0123426 | A1* | 4/2019 | Bryce | H01Q 1/22 |
| 2019/0334636 | A1* | 10/2019 | Li | H04B 7/0617 |
| 2020/0321700 | A1* | 10/2020 | Wu | H01Q 1/405 |
| 2020/0403325 | A1* | 12/2020 | Wu | H01Q 21/0006 |
| 2020/0411961 | A1* | 12/2020 | Kasani | H01Q 21/24 |
| 2021/0021019 | A1* | 1/2021 | Hou | H01Q 21/26 |

* cited by examiner

MULTIBAND BASE STATION ANTENNAS HAVING IMPROVED GAIN AND/OR INTERBAND ISOLATION

CROSS-REFERENCE TO RELATED APPLICATION

The present application claims priority under 35 U.S.C. § 119 to U.S. Provisional Application Ser. No. 62/912,745, filed Oct. 9, 2019, the entire content of which is incorporated herein by reference.

FIELD

The present invention generally relates to radio communications and, more particularly, to multiband base station antennas utilized in cellular and other communications systems

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The base station antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is generally perpendicular relative to the plane defined by the horizon.

A common base station configuration is a "three sector" configuration in which the cell is divided into three 120° sectors in the azimuth plane, and the base station includes three base station antennas that provide coverage to the three respective sectors. The azimuth plane refers to a horizontal plane that bisects the base station antenna that is parallel to the plane defined by the horizon. In a three sector configuration, the antenna beams generated by each base station antenna typically have a Half Power Beam Width ("HPBW") in the azimuth plane of about 65° so that the antenna beams provide good coverage throughout a 120° sector. Typically, each base station antenna will include several vertically-extending columns of radiating elements, which are often referred to as "linear arrays." Each linear array generates an antenna beam or, if the linear array is formed using dual-polarized radiating elements, forms an antenna beam at each of two orthogonal polarizations. The radiating elements used to form the linear arrays typically have a HPBW of approximately 65° so that the antenna beams generated by each linear array will provide coverage to a 120° sector in the azimuth plane. The base station antenna may include linear arrays that operate in different frequency bands. Base station antennas that have arrays of radiating elements that operate in two or more different frequency bands are referred to as "multiband antennas."

Base station antennas may also include one or more two-dimensional arrays of radiating elements that each have multiple rows and columns of radiating elements. For example, base station antennas are in use today that include arrays with either three or four columns of radiating elements. Two RF ports (per polarization) are coupled to all of the columns of radiating elements through a beamforming network such as a Butler Matrix. The beamforming network generates two separate antenna beams (per polarization) based on the RF signals input at the two RF ports (per polarization). The antenna beams generated by the two-dimensional array of radiating elements may have, for example, azimuth HPBW values of between about 27°-39°, and the pointing directions for the two antenna beams in the azimuth plane are typically at about −27° and about 27°, respectively. These two-dimensional arrays of radiating elements may be used to split a 120° sector into two 60° sectors in the azimuth plane, with the first and second antenna beams generated by the array (at each polarization) being used to cover the respective first and second 60° sectors. Splitting each 120° sector into two sub-sectors increases system capacity because each antenna beam provides coverage to a smaller area, and therefore can provide higher antenna gain and/or allow for frequency reuse within a 120° sector.

SUMMARY

Pursuant to embodiments of the present invention, multiband base station antennas are provided that include a backplane, a first array and a second array. The first array includes a plurality of radiating elements that are mounted to extend forwardly from the backplane, the radiating elements in the first array arranged in a plurality of vertically-extending columns and a plurality of horizontally-extending rows, where an uppermost of the horizontally-extending rows of the first array and a lowermost of the horizontally-extending rows of the first array each include a first number of radiating elements, and at least one of the other horizontally-extending rows of the first array includes a second number of radiating elements, where the second number is greater than the first number. The second array includes a plurality of radiating elements that are mounted to extend forwardly from the backplane and that are vertically offset from each other. At least one of the radiating elements in the uppermost of the horizontally-extending rows of the first array is not vertically aligned with any of the radiating elements in the lowermost of the horizontally-extending rows of the first array.

In some embodiments, a leftmost of the vertically-extending columns of the first array and a rightmost of the vertically-extending columns of the first array may each have fewer radiating elements than does at least one of a plurality of inner vertically-extending columns of the first array that are positioned between the leftmost and rightmost of the vertically-extending columns of the first array.

In some embodiments, an uppermost of the radiating elements in the second array may be horizontally adjacent a first of the radiating elements in the first array. In such embodiments, a second of the radiating elements in the second array may likewise be horizontally adjacent a second of the radiating elements in the first array. In such embodiments, the first and second of the radiating elements in the second array may be substantially vertically aligned with the leftmost of the vertically-extending columns of the first array. Additionally, the first and second of the radiating elements in the second array may also or alternatively be horizontally offset from at least some of the other radiating elements in the second array, and/or may be positioned farther from a vertical axis extending down a middle of the backplane than are other of the radiating elements in the second array.

In some embodiments, the multiband base station antenna may further include a third array that includes a plurality of radiating elements that are mounted to extend forwardly from the backplane, the radiating elements in the third array arranged in a plurality of vertically-extending columns and a plurality of horizontally-extending rows, where an uppermost of the horizontally-extending rows and a lowermost of the horizontally-extending rows of the third array each include the first number of radiating elements, and at least one of the other horizontally-extending rows of the third array includes the second number of radiating elements. The antenna may also include a fourth array that has a plurality of radiating elements that are mounted to extend forwardly from the backplane and that are vertically offset from each other. At least one of the radiating elements in the lowermost of the horizontally-extending rows of the third array may not be vertically aligned with any of the radiating elements in the uppermost of the horizontally-extending rows of the third array. In such embodiments, the first array may be horizontally spaced apart from the fourth array, and the second array may be horizontally spaced apart from the third array.

In some embodiments, the first array may be configured to operate in a first frequency band and the second array may be configured to operate in a second frequency band that at least partially overlaps with the first frequency band.

Pursuant to further embodiments of the present invention, multiband base station antennas are provided that include a first array that has a plurality of radiating elements that are arranged in a plurality of vertically-extending columns and a plurality of horizontally-extending rows, where a lowermost of the horizontally-extending rows of the first array includes a first number of radiating elements, and at least one of the other horizontally-extending rows of the first array includes a second number of radiating elements, where the second number is larger than the first number. These antennas further include a second array that has a plurality of radiating elements that are vertically offset from each other. A first of the radiating elements in the second array is substantially located at an intersection between a first vertical axis that extends along a first of the vertically-extending columns of the first array and a first horizontal axis that extends along a first of the horizontally-extending rows of the first array.

In some embodiments, the first array may be configured to operate in a first frequency band and the second array may be configured to operate in a second frequency band that only partially overlaps with the first frequency band.

In some embodiments, a second of the radiating elements in the second array may be substantially located at an intersection between the first vertical axis and a second horizontal axis that extends along the lowermost of the horizontally-extending rows of the first array. In such embodiments, the first and second radiating elements in the second array are the two uppermost radiating elements in the second array. The first and second radiating elements of the second array may be substantially vertically aligned with a leftmost of the vertically-extending columns of the first array. Additionally, the first of the horizontally-extending rows of the first array may be next to the lowermost of the horizontally-extending rows of the first array.

In some embodiments, the two uppermost radiating elements of the second array may be horizontally offset from at least some of the remaining radiating elements of the second array.

In some embodiments, all of the horizontally-extending rows of the first array that have the first number of radiating elements may be closer to a center of the backplane than are all of the horizontally-extending rows of the first array that have the second number of radiating elements.

In some embodiments, a leftmost of the vertically-extending columns of the first array may have fewer radiating elements than does at least one of the other vertically-extending columns of the first array.

In some embodiments, an uppermost of the radiating elements in the second array may be horizontally adjacent a first of the radiating elements in the first array. In such embodiments, a second of the radiating elements in the second array may be horizontally adjacent a second of the radiating elements in the first array. Additionally, the first and second of the radiating elements in the second array may be substantially vertically aligned with the leftmost of the vertically-extending columns of the first array. In some embodiments, the first and second of the radiating elements in the second array may be horizontally offset from at least some of the other radiating elements in the second array.

In some embodiments, the multiband base station antenna may further include a third array that includes a plurality of radiating elements that are arranged in a plurality of vertically-extending columns and a plurality of horizontally-extending rows, where an uppermost of the horizontally-extending rows of the third array includes the first number of radiating elements, and at least one of the other horizontally-extending rows of the third array includes the second number of radiating elements. The antennas may also include a fourth array that has a plurality of radiating elements that are vertically offset from each other. A first of the radiating elements in the fourth array may be substantially located at an intersection between a second vertical axis that extends along a first of the vertically-extending columns of the third array and a first horizontal axis that extends along a first of the horizontally-extending rows of the third array.

In some embodiments, the first array may be horizontally spaced apart from the fourth array, and the second array may be horizontally spaced apart from the third array.

Pursuant to still further embodiments of the present invention, multiband base station antennas are provided that include a first array that has a plurality of radiating elements that are arranged in a plurality of vertically-extending columns and a plurality of horizontally-extending rows, where a lowermost of the horizontally-extending rows of the first array includes a first number of radiating elements, and an uppermost of the other horizontally-extending rows of the first array includes a second number of radiating elements, where the second number is larger than the first number. These antennas further include a third array that is mounted below the first array, the third array including a plurality of radiating elements that are arranged in a plurality of vertically-extending columns and a plurality of horizontally-extending rows, where an uppermost of the horizontally-extending rows of the third array includes the first number of radiating elements, and a lowermost of the horizontally-extending rows of the third array includes the second number of radiating elements.

In some embodiments, these multiband base station antennas may further include a second array that has a plurality of radiating elements that are vertically offset from each other, where a first of the radiating elements in the second array is substantially located at an intersection between a first vertical axis that extends along a first of the vertically-extending columns of the first array and a first horizontal axis that extends along a first of the horizontally-extending rows of the first array. The multiband base station antennas may additionally include a fourth array that has a plurality of radiating elements that are vertically offset from each other, where a first of the radiating elements in the fourth array is substantially located at an intersection between a second vertical axis that extends along a first of the vertically-extending columns of the third array and a second horizontal axis that extends along a first of the horizontally-extending rows of the third array.

In some embodiments, the first array may be horizontally spaced apart from the fourth array, and the second array may be horizontally spaced apart from the third array.

In some embodiments, the first and third arrays may be configured to operate in a first frequency band and the second and fourth arrays may be configured to operate in a second frequency band that only partially overlaps with the first frequency band.

DETAILED DESCRIPTION

Figure 1A:
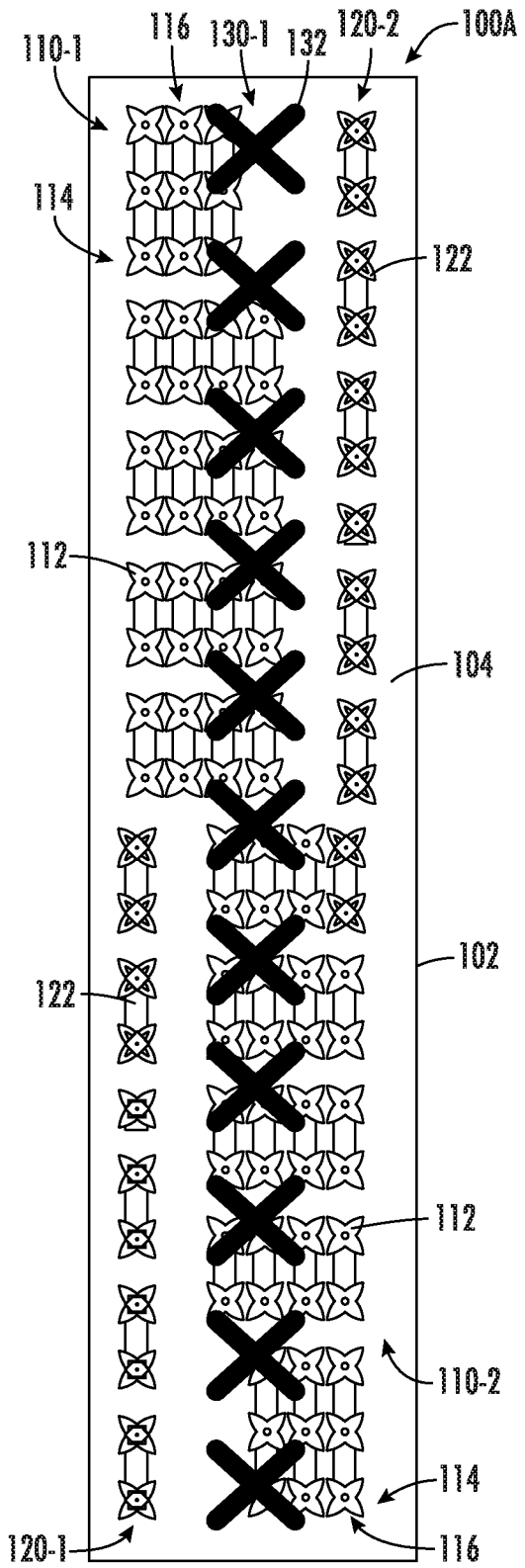
FIG. 1A PRIOR ART
FIG. 1A is a schematic front view of a conventional multiband base station antenna that operates in three different frequency bands.

Pursuant to embodiments of the present invention, multiband base station antennas are provided that include at least a first two-dimensional array of radiating elements that operates in a first frequency band and a second array of radiating elements (which may be a linear array) that operates in a second frequency band that overlaps with the first frequency band. These arrays of radiating elements are mounted to extend forwardly from a reflector. The radiating elements in the first and second arrays are arranged on the reflector in new ways that may improve the isolation between arrays while maintaining good front-to-back ratio and improved and/or acceptable gain for each array.

In some embodiments, multiband base station antennas are provided that include a first array that has a plurality of radiating elements that are arranged in a plurality of vertically-extending columns and a plurality of horizontally-extending rows. An uppermost and a lowermost of the horizontally-extending rows of the first array each include a first number of radiating elements (e.g., 3), and at least one of the other horizontally-extending rows of the first array includes a second number of radiating elements (e.g., 4), where the second number is greater than the first number. These antennas further include a second array that has a plurality of radiating elements that are vertically offset from each other. At least one of the radiating elements in the uppermost of the horizontally-extending rows of the first array is not vertically aligned with any of the radiating elements in the lowermost of the horizontally-extending rows of the first array.

In these multiband base station antennas, both a leftmost and a rightmost of the vertically-extending columns of the first array may have fewer radiating elements than does at least one of the inner vertically-extending columns of the first array. Additionally, the two uppermost of the radiating elements in the second array may be horizontally adjacent respective first and second of the radiating elements in the first array. In some embodiments, the two uppermost of the radiating elements in the second array may be substantially vertically aligned with the leftmost of the vertically-extending columns of the first array. Additionally, the two uppermost of the radiating elements in the second array may be horizontally offset from at least some of the other radiating elements in the second array.

The multiband base station antennas may also include third and fourth arrays of radiating elements. The third array includes a plurality of radiating elements that are arranged in a plurality of vertically-extending columns and a plurality of horizontally-extending rows, where an uppermost and a lowermost of the horizontally-extending rows of the third array each include the first number of radiating elements, and at least one of the other horizontally-extending rows of the third array includes the second number of radiating elements. The fourth array includes a plurality of radiating elements that are vertically offset from each other. At least one of the radiating elements in the lowermost of the horizontally-extending rows of the third array is not vertically aligned with any of the radiating elements in the uppermost of the horizontally-extending rows of the third array. The first array may be horizontally spaced apart from the fourth array, and the second array may be horizontally spaced apart from the third array. The first array may be mounted above the third array.

In other embodiments, multiband base station antennas are provided that again include a first array that has a plurality of radiating elements that are arranged in a plurality of vertically-extending columns and a plurality of horizontally-extending rows, where a lowermost of the horizontally-extending rows of the first array includes a first number of radiating elements, and at least one of the other horizontally-extending rows in the first array includes a second number of radiating elements, where the second number is larger than the first number. The antenna further includes a second array that includes a plurality of radiating elements that are vertically offset from each other. A first of the radiating elements in the second array is substantially located at an intersection between a first vertical axis that extends along a first of the vertically-extending columns of the first array and a first horizontal axis that extends along a first of the horizontally-extending rows of the first array. A second of the radiating elements in the second array may be substantially located at an intersection between the first vertical axis and a second horizontal axis that extends along the lowermost of the horizontally-extending rows of the first array.

The first and second radiating elements in the second array may be the two uppermost radiating elements in the second array, and the first of the horizontally-extending rows of the first array may be the next to the lowermost of the horizontally-extending rows of the first array. In some embodiments, the first and second radiating elements of the second array may be substantially vertically aligned with a leftmost of the vertically-extending columns of the first array.

In some embodiments, the two uppermost radiating elements of the second array may be horizontally offset from at least some of the remaining radiating elements of the second array. In some embodiments, all of the horizontally-extending rows of the first array that have the first number of radiating elements may be closer to a center of the backplane than are all of the horizontally-extending rows of the first array that have the second number of radiating elements. In some embodiments, an uppermost of the radiating elements in the second array is horizontally adjacent a first of the radiating elements in the first array.

Before describing specific example embodiments of the multiband base station antennas according to embodiments of the present invention, it is helpful to review the current approaches for implementing antennas with comparable arrays of radiating elements.

FIG. 1A is a schematic front view of a conventional multiband base station antenna 100A that operates in three different frequency bands. As shown in FIG. 1A, the base station antenna 100A includes five arrays 110-1, 110-2, 120-1, 120-2, 130-1 of radiating elements 112, 122, 132 that are mounted to extend forwardly from a backplane 102. Herein, when multiple of the same elements are included in an antenna, the elements may be referred to individually by their full reference numeral (e.g., array 120-2) and collectively by the first part of their reference numerals (e.g., the arrays 120). The backplane 102 includes a reflector surface 104 (also referred to herein as a reflector). The reflector 104 may comprise a metallic sheet that serves as a ground plane for the radiating elements 112, 122, 132 and that also redirects forwardly much of the backwardly-directed radiation emitted by the radiating elements 112, 122, 132.

Array 110-1 is a two-dimensional array of radiating elements 112 that includes a plurality of rows 114 and columns 116 of radiating elements 112. As shown in FIG. 1A, some of the rows 114 include three radiating elements 112 while other of the rows 114 include four radiating elements 112. The rows 114 that include three radiating elements 112 are at the top of the array (and hence adjacent the top of base station antenna 100A), while the rows 114 that have four radiating elements are closer to the center of the antenna 100A. In an example embodiment, each radiating element 112 may be configured to operate in the 1695-2400 MHz frequency band. The array 110-1 may be connected to four RF ports (not shown) via a feed network (not shown). The feed network may include beamforming networks (e.g., Butler matrix based beamforming networks) that are configured to generate first and second antenna beams (at each of two polarizations) in response to RF signals input at the respective four RF ports, where each antenna beam is scanned away from the boresight pointing direction of the radiating elements 112 in the azimuth plane. The array 110-1 is configured to operate as a sector splitting array that generates two antenna beams (at each of two polarizations for a total of four antenna beams) that have azimuth half power beamwidths of approximately 27°-33°. U.S. Pat. No. 9,831,548 describes the operation of two-dimensional arrays of radiating elements such as array 110-1 that are used to split a sector in greater detail. The entire content of U.S. Pat. No. 9,831,548 is incorporated herein by reference. Array 110-2 may be identical to array 110-1 except that (1) array 110-2 is located on the bottom half of the reflector 104 and (2) the orientation of array 110-2 is rotated by 180° with respect to the orientation of array 110-1. Thus, in array 110-2, the rows 114 that include three radiating elements 112 are at the bottom of the array (and hence adjacent the bottom of base station antenna 100A) instead of at the top of the array 110-2 as in array 110-1, while the rows 114 that have four radiating elements 112 are closer to the center of the antenna 100, and the column 116 that has fewer radiating elements 112 is on the left side of array 110-2 as opposed to the right side as is the case with array 110-1.

Array 120-1 is a linear array of radiating elements 122 that includes a total of eleven radiating elements 122 that are aligned along a vertical axis. In an example embodiment, each radiating element 122 may be configured to operate in the 1695-2690 MHz frequency band or the 1427-2690 MHz frequency band. The array 120-1 may be connected to two RF ports (not shown) via a feed network (not shown). The array 120-1 is configured to generate two antenna beams (one at each of two polarizations) that each provide coverage to a full 120° sector in the azimuth plane. Array 120-2 may be identical to array 120-1 except that (1) array 120-2 is located on the top right side of the reflector 104 as opposed to the bottom left side of the reflector 104.

Array 130-1 is a linear array of radiating elements 132 that includes a total of eleven radiating elements 132 that are aligned along a vertical axis that extends down the center of the reflector 104. In an example embodiment, each radiating element 132 may be configured to operate in the 694-960 MHz frequency band. Since radiating elements 132 are designed to operate at lower frequencies, they may be referred to herein as "low-band" radiating elements, as may the other radiating elements disclosed herein that may be designed to operate in the 694-960 MHz frequency band or other similar frequency bands. The array 130-1 may be connected to two RF ports (not shown) via a feed network (not shown). The array 130-1 is configured to generate two antenna beams (one at each of two polarizations) that each provide coverage to a full 120° sector in the azimuth plane.

Since radiating elements 112 and 122 are both designed to operate at higher frequencies, they may be referred to herein as "high-band" radiating elements, as may the other radiating elements disclosed herein that may be designed to operate in the 1427-2690 MHz frequency band or a portion thereof. The radiating elements 132 are shown schematically using large X's in FIG. 1A (and the low-band radiating elements are also shown schematically in various of the other figures).

Array 120-2 is positioned very close to the right edge of the reflector 104 in order to increase the isolation between array 110-1 and array 120-2. As described above, the radiating elements 112, 122 in these arrays may be designed to operate in first and second frequency bands that overlap with each other, and hence RF energy emitted by the radiating elements 112 of array 110-1 may have a tendency to couple to the radiating elements 122 of array 120-2, and vice versa. While the energy that is coupled from the radiating elements 112, 122 of one array 110-1, 120-2 to the other array 110-1, 120-2 will tend to re-radiate, the re-radiated energy tends to distort the antenna beams in undesirable ways. Thus, increased isolation between arrays 110-1 and 120-2 is generally desirable (and similarly, between arrays 110-2 and 120-1), and can be achieved by increasing the physical distance between arrays 110-1, 120-2 and between arrays 110-2 and 120-1. Cellular operators, however, prefer base station antenna having smaller widths, and thus there are often commercially-imposed limits on the acceptable width for a particular type of base station antenna. As such, it is often not possible to completely eliminate coupling between array 110-1, 120-2 and between arrays 110-2 and 120-1.

Array 110-1 is vertically offset from array 110-2 (namely, positioned above array 110-2), and the two arrays 110-1, 110-2 are also horizontally offset from each other so that the arrays are not perfectly aligned along a vertical axis. Additionally, each array 120 is positioned very close to the left edge of the reflector 104 in order to increase the isolation between the array 120 and the array 110 that is adjacent to it. The base station antenna 100A may provide acceptable levels of isolation between each array 110 and an adjacent array 120. However, base station antenna 100A requires a relatively wide reflector 104 in order to allow the two arrays 110-1, 110-2 to be horizontally staggered with respect to each other in the manner shown in FIG. 1A.

Figure 1B:
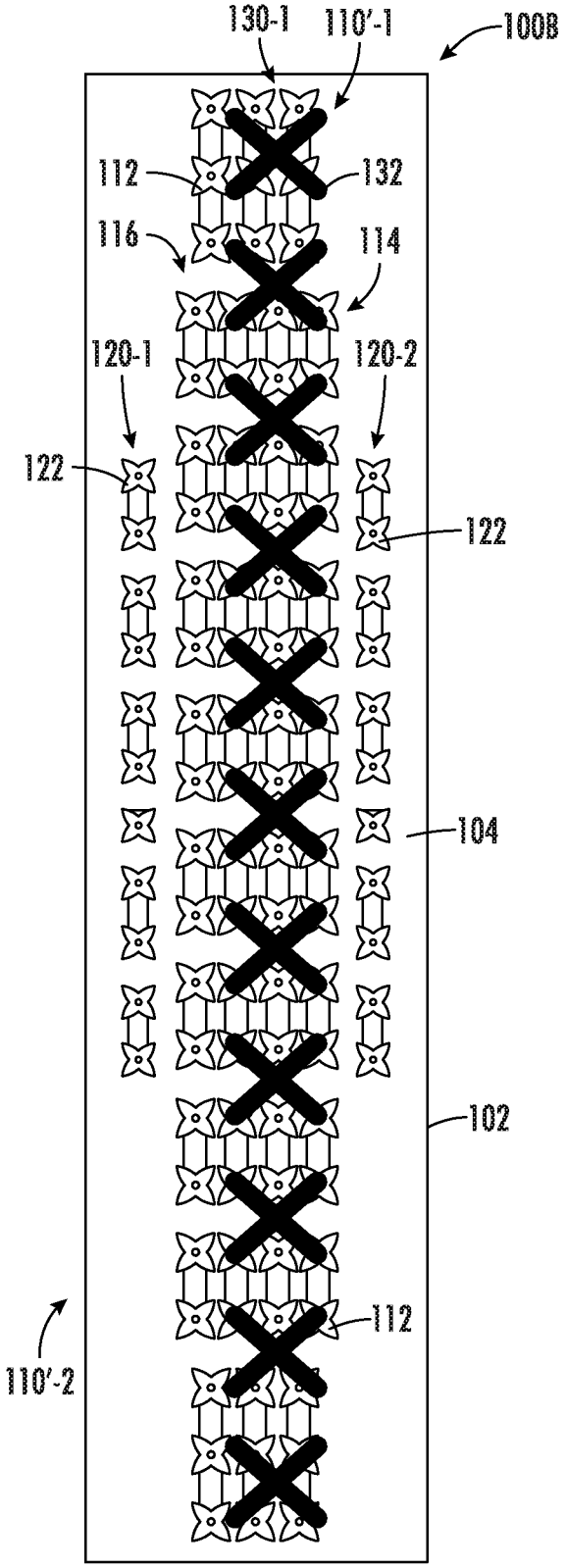
FIG. 1B PRIOR ART
FIG. 1B is a schematic front view of another conventional multiband base station antenna that is a modified version of the base station antenna of FIG. 1A.

FIG. 1B is a front view of another conventional multiband base station antenna 100B that is a modified version of base station antenna 100A of FIG. 1A. As shown in FIG. 1B, the base station antenna 100B again includes five arrays 110'-1, 110'-2, 120-1, 120-2, 130-1 of radiating elements 112, 122, 132.

Base station antenna 100B differs from base station 100A in that arrays 110-1, 110-2 of base station antenna 100A are replaced in base station antenna 100B with arrays 110'-1, 110'-2. As shown in FIG. 1B, the arrays 110-1, 110-2 are not horizontally offset (staggered) from each other. Instead, each of the columns 116 of radiating elements 112 included in array 110'-1 is vertically aligned with a column 116 of radiating elements 112 of array 110'-2. Additionally, in arrays 110'-1, 110'-2, the horizontally-extending rows 114 that only include three radiating elements 112 are centered along a vertical axis that bisects the arrays 110-1, 110-2, and hence the radiating elements 112 in the horizontally-extending rows 114 that only include three radiating elements 112 are not perfectly aligned in the columns 116. This arrangement results in improved alignment of the phase centers for the radiating elements 112 of arrays 110'-1, 110'-2.

Base station antenna 100B further differs from base station 100A in that arrays 120-1 and 120-2 of base station 100B are mounted along respective side edges of a middle portion of the reflector 104. As a result, each radiating element 122 in array 120-1 is horizontally aligned with a respective one of the radiating elements 122 in array 120-2. In base station antenna 100B, each array 120 may be spaced farther away from the edge of the reflector 104 that is adjacent to the array 120. This may improve the front-to-back ratio performance of the arrays 120. However, as can be seen in FIG. 1B, in order to keep the width of the antenna 100B relatively narrow, each array 120 is located in very close proximity to a column 116 of the radiating elements 112 in an adjacent array 110'. As a result, isolation between each array 110' and a corresponding one of arrays 120 may be poor, and the antenna patterns for all of the arrays 110', 120 may be degraded as a result of poor isolation.

Figure 1C:
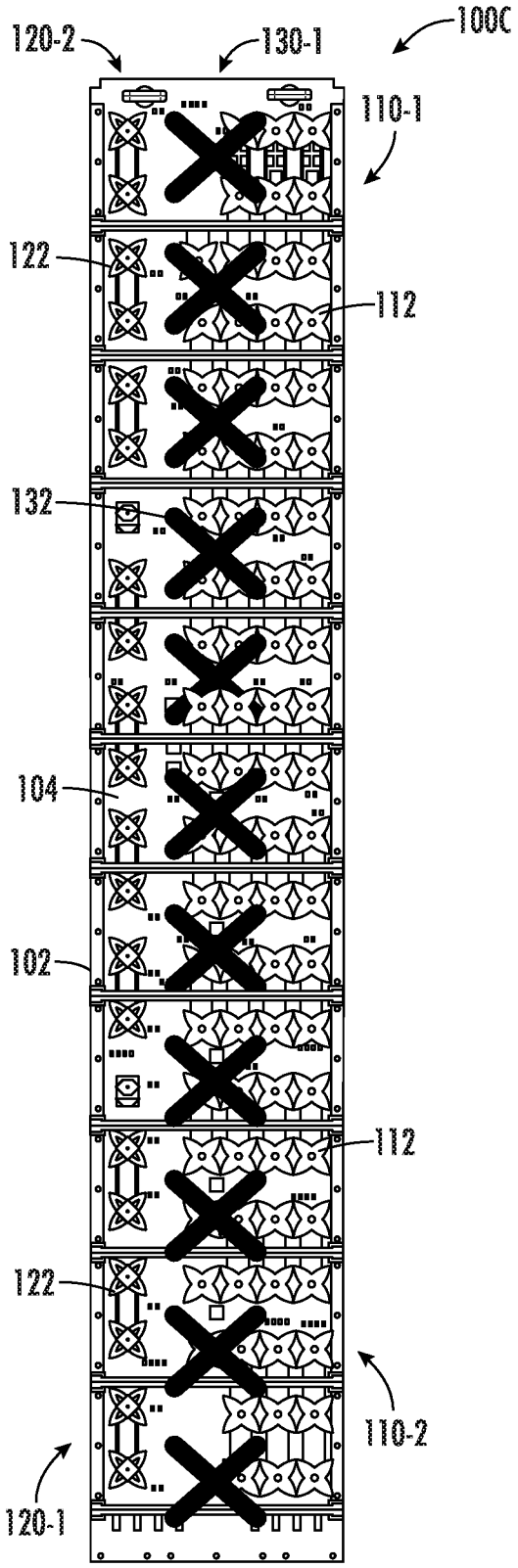
FIG. 1C PRIOR ART
FIG. 1C is a schematic front view of a conventional multiband base station antenna that is another modified version the of base station antenna of FIG. 1A.

FIG. 1C is a front view of another conventional multiband base station antenna 100C that is another modified version of base station antenna 100A of FIG. 1A. As shown in FIG. 1C, base station antenna 100C includes the same five arrays 110-1, 110-2, 120-1, 120-2, 130-1 of radiating elements 112, 122, 132 that are included in base station antenna 100A. Base station antenna 100C differs from base station 100A, however, in that the arrays 110-1 and 110-2 are both arranged on the right side of the reflector 104 (note that in other embodiments the arrays 120 could alternatively both be arranged on the left side of the reflector 104) and are mounted at the top and bottom of the antenna 100C, respectively, so that the two linear arrays 110-1, 110-2 are vertically aligned with each other. Likewise, arrays 120-1 and 120-2 are both arranged on the left side of the reflector 104 (note that in other embodiments the arrays 120 could alternatively both be arranged on the right side of the reflector 104) and are mounted at the top and bottom of the antenna 100C, respectively, so that the two linear arrays 120-1, 120-2 are vertically aligned with each other.

Pursuant to embodiments of the present invention, base station antennas are provided that have arrays that are mounted on a reflector in different arrangements that may provide better performance.

Figure 2:
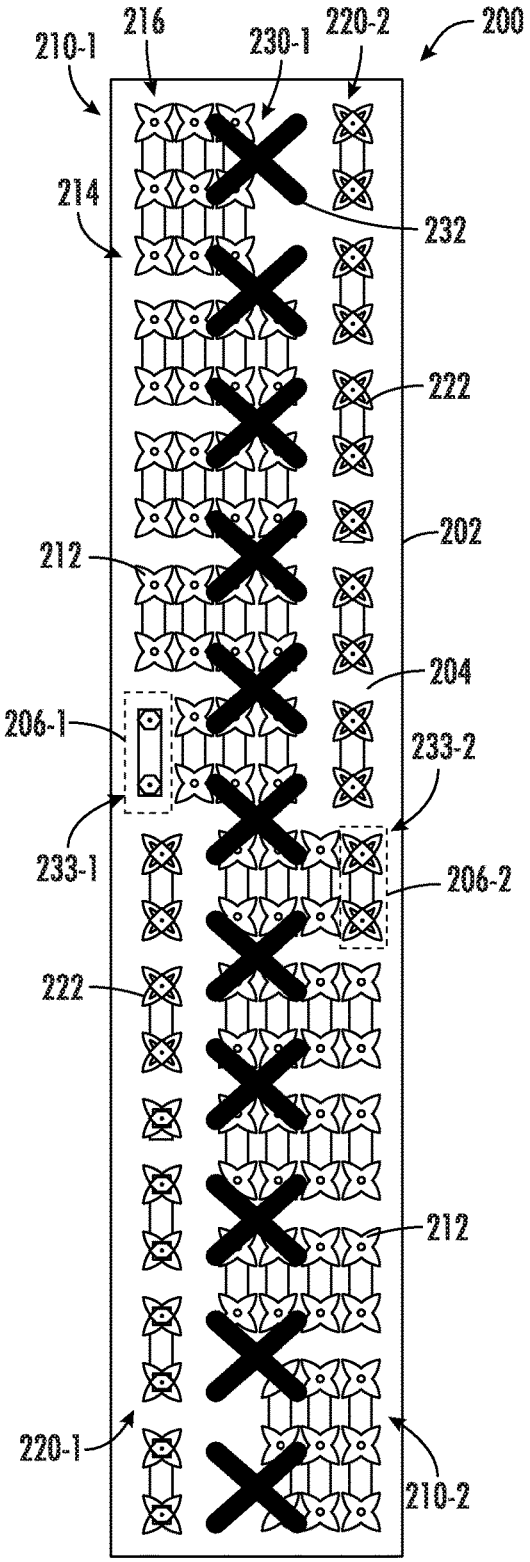
FIGS. 2-9 are front views of multiband base station antennas according to various embodiments of the present invention.

FIG. 2 is a front view of a multiband base station antenna 200 according to embodiments of the present invention. As shown in FIG. 2, the base station antenna 200 includes five arrays 210-1, 210-2, 220-1, 220-2, 230-1 of radiating elements 212, 222, 232 that are mounted to extend forwardly from a backplane 202. The backplane 202 includes a reflector surface 204. The reflector 204 may comprise a metallic sheet that serves as a ground plane for the radiating elements 212, 222, 232 and that also redirects forwardly much of the backwardly-directed directed radiation emitted by the radiating elements 212, 222, 232.

Each radiating element 212, 222, 232 may be a dual-polarized radiating element that includes a first polarization radiator and a second polarization radiator. For example, each radiating element 212, 222, 232 may be a cross-dipole radiating element that includes a slant −45° dipole radiator and a slant +45° degree dipole radiator. It will be appreciated, however, that in other embodiments different types of radiating elements may be used to implement any of the arrays 210, 220, 230 (and this is true with respect to all of the embodiments disclosed herein). Thus, for example, in other embodiments the radiating elements 212, 222, 232 may be implemented as patch radiating elements, slot radiating elements, horn radiating elements or any other suitable radiating element, and these radiating elements may be single polarized or dual-polarized radiating elements.

Arrays 210-1 and 210-2 are each two-dimensional arrays that include a plurality of horizontally-extending rows 214 and vertically-extending columns 216 of radiating elements 212. In an example embodiment, each radiating element 212 may be configured to operate in the 1695-2400 MHz frequency band. As shown in FIG. 2, some of the horizontally-extending rows 214 include three radiating elements 212 while other of the horizontally-extending rows 214 include four radiating elements 212. However, two of the radiating elements 112 that were included in each of the arrays 110-1, 110-2 of the conventional base station antennas 100A-100C are omitted from the corresponding arrays 210-1, 210-2 of base station antenna 200 and replaced with different radiating elements 222 that are part of the respective arrays 220-1, 220-2.

In particular, the two radiating elements 112 that were included at the bottom of the leftmost vertically-extending column 116 of array 110-1 of base station antenna 100A are omitted in array 210-1. This creates a first open space 206-1 on the reflector 204. Similarly, the two radiating elements 112 that were included at the top of the rightmost vertically-extending column 116 of array 110-2 are omitted in array 210-2. This creates a second open space 206-2 on the reflector 204. As will be explained in further detail below, a first pair 223-1 of radiating elements 222 are mounted in the first open space 206-1 and a second pair 223-2 of radiating elements 222 are mounted in the second open space 206-2. The first pair 223-1 of radiating elements 222 that are mounted in the first open space 206-1 are coupled to the feed network for array 220-1 and hence are part of array 220-1. Similarly, the second pair 223-2 of radiating elements 222 that are mounted in the second open space 206-2 are coupled to the feed network for array 220-2 and hence are part of array 220-2. As can be seen in FIG. 2, the additional pairs 223 of radiating elements 222 that are added to each array 220 are offset in the horizontal direction from the remaining radiating elements 222 in the respective arrays 220-1, 220-2. In an example embodiment, the additional two radiating elements 222 added to each array 220 are offset in the horizontal direction from the remaining radiating elements 222 in the respective arrays 220-1, 220-2 by between 10-25 mm.

Similar to the arrays 110 in base station antennas 100A-100C, each array 210-1, 210-2 may be connected to four RF ports (not shown) via a feed network (not shown). The feed network may include beamforming networks that are configured to generate first and second antenna beams (at each of two polarizations) in response to RF signals input at the four RF ports, where each antenna beam is scanned away from the boresight pointing direction of the radiating elements 212 in the azimuth plane so that each array 210-1, 210-2 is configured to operate as a sector splitting array that generates two antenna beams (one at each of two polarizations) that have azimuth half power beamwidths of approximately 27°-33°.

Array 220-1 comprises a linear array that includes a single vertically-extending column of radiating elements 222. In an example embodiment, each radiating element 222 may be configured to operate in the 1695-2690 MHz frequency band. In another example embodiment, each radiating element 222 may be configured to operate in the 1427-2690 MHz frequency band. Array 220-1 includes a total of thirteen radiating elements 222 (as compared to the eleven radiating elements 122 included in each array 120 of base station antennas 100A-100C) as array 220-1 includes the additional pair 223-1 of radiating elements 222 that are mounted in the first open space 206-1. Array 220-1 is mounted on reflector 204 below array 210-1. In this particular embodiment, array 220-1 is located close to the left side of the reflector 204, but not quite as close as the leftmost vertically-extending column 216 of array 210-1. As a result, the radiating elements 222 are generally aligned along a vertical axis that extends between the two leftmost columns 216 of array 210-1. However, the additional pair 223-1 of radiating elements 222 (i.e., the uppermost two radiating elements 222 of array 220-1) that are mounted in the first open space 206-1 may be offset in the horizontal direction from the remaining radiating elements 222 of array 220-1. As a result, these upper two radiating elements 222 of array 220-1 may be, for example, aligned underneath the leftmost vertically-extending column 216 of array 210-1.

Array 220-1 is connected to two RF ports (not shown) via a feed network (not shown), and is configured to generate two antenna beams (one at each of two polarizations) that each provide coverage to a full 120° sector in the azimuth plane. Array 220-2 may be identical to array 220-1 except that array 220-2 is located on the top right side of the reflector 204 as opposed to the bottom left side of the reflector 204, and the orientation of array 220-2 is rotated 180° from the orientation of array 220-1. It should be noted that array 220-2 also includes thirteen radiating elements 222 since array 220-2 includes the second pair 223-2 of radiating elements 222 that are mounted in the second open space 206-2.

Array 230-1 is a single vertically-extending column of radiating elements 232 that are aligned along a vertical axis that extends down the center of the reflector 204. This may help minimize the azimuth beamwidth of the antenna beams generated by array 230-1. Array 230-1 includes a total of eleven radiating elements 232. In an example embodiment, each radiating element 232 may be configured to operate in the 694-960 MHz frequency band. Array 230-1 may be connected to two RF ports (not shown) via a feed network (not shown). Array 230-1 is configured to generate two antenna beams (one at each of two polarizations) that each provide coverage to a full 120° sector in the azimuth plane.

Base station antenna 200 may provide improved performance as compared to the base station antennas 100A-100C. For example, arrays 220-1, 220-2 in base station antenna 200 each include thirteen radiating elements 222 as opposed to the eleven radiating elements 122 that are included in arrays 120-1, 120-2 of base station antennas 100A-100C. As a result, each array 220 may have a gain that is about 7-8% higher than the gain of each array 120. As can also be seen, all but two of the radiating elements 222 of each array 220 are spaced relatively far apart from the arrays 110, thereby maintaining good isolation performance. Additionally, by horizontally offsetting some of the radiating elements in each array 220 from the remaining radiating elements 222 it is possible to optimize the trade-off between isolation and front-to-back ratio performance. The omission of two of the radiating elements 212 in arrays 210-2, 210-2 reduces the gain of each array 210 by about 3%, but this reduction in gain is generally considered acceptable.

Since two radiating elements 212 are omitted from each array 210 (as compared to the arrays 110 include in the conventional antennas 100A-100C), each array 210 has horizontally-extending rows 214 of radiating elements 212 that only have three radiating elements 212 at both the top and the bottom of the array 210, while the middle of the array 210 may include horizontally-extending rows 214 of radiating elements 212 that have four radiating elements 212 each. Additionally, as shown in FIG. 2, the radiating elements 212 included in the horizontally-extending rows 214 of radiating elements 212 that have three radiating elements 212 each that are at the top of each array 210 are not vertically aligned with the radiating elements 212 included in the horizontally-extending rows 214 of radiating elements 212 that have three radiating elements 212 each that are at the bottom of each respective array 210. For example, in array 210-1, the three uppermost horizontally-extending rows 214 of radiating elements 212 are part of the left three vertically-extending columns 216, while the three lowermost horizontally-extending rows 214 of radiating elements 212 are part of the right three vertically-extending columns 216. This arrangement improves isolation between array 210-1 and array 220-2 while also allowing space on the reflector 204 for adding the two additional radiating elements 222 to array 220-1. Thus, the three lowermost horizontally-extending rows 214 of radiating elements 212 each include a radiating element 212 that is not vertically aligned with any of the radiating elements 212 in the two lowermost horizontally-extending rows 214 of radiating elements 212.

Figure 3:
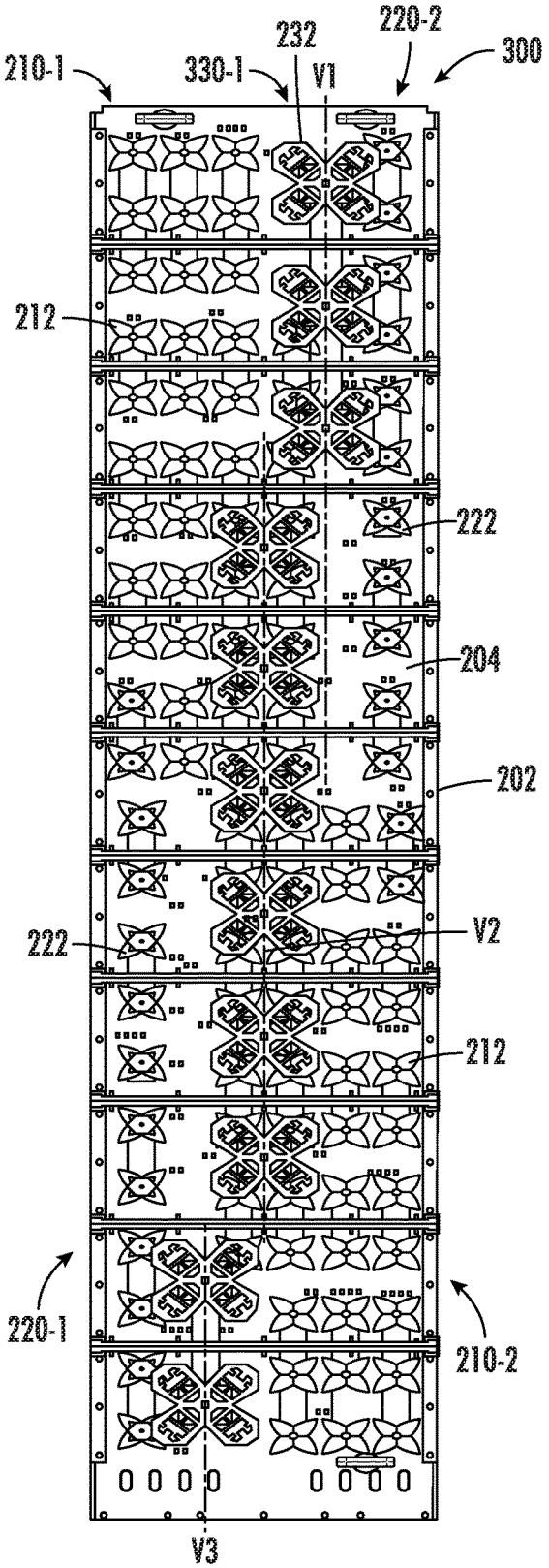

FIG. 3 is a front view of a multiband base station antenna 300 according to further embodiments of the present invention. As shown in FIG. 3, the base station antenna 300 includes arrays 210-1, 210-2 of radiating elements 212, arrays 220-1, 220-2 of radiating elements 222, and an array 330-1 of radiating elements 232. Each of the arrays 210-1, 210-2, 220-1, 220-2, 330-1 are mounted to extend forwardly from a backplane 202. The backplane 202 and the radiating elements 212, 222, 232 included in base station antenna 300 (and in the remaining embodiments of the present invention described below, with the exception of the radiating elements 732 included in the embodiment of FIG. 7) may be identical to the backplane 202 and radiating elements 212, 222, 232, respectively, that are described above with reference to the base station antenna 200. Accordingly, these elements are assigned the same reference numerals and further description of these elements will be omitted. The arrays 210-1, 210-2, 220-1, 220-2 in this particular embodiment are also identical to the correspondingly numbered arrays in the base station antenna 200 of FIG. 2, so further description of these arrays will also be omitted.

Base station antenna 300 differs from base station antenna 200 in that the radiating elements 232 included in low-band array 330-1 of antenna 300 are horizontally staggered with respect to each other. In particular, the top three radiating elements 232 are aligned along a vertical axis V1 that extends down the right side of the reflector 204, the six radiating elements 232 below the top two radiating elements are aligned along a vertical axis V2 that extends down the middle of the reflector 204, and the bottom three radiating elements 232 are aligned along a vertical axis V3 that extends down the left side of the reflector 204. By introducing this horizontal stagger in the radiating elements 232 of array 330-1 it is possible to reduce the azimuth beamwidth of the antenna beams generated by array 330-1. This allows for the use of smaller radiating elements 232 (which have slightly larger azimuth beamwidths). The use of the smaller radiating elements 232 may reduce the cost of the base station antenna 300 as compared to the cost of base station antenna 200.

Figure 4:
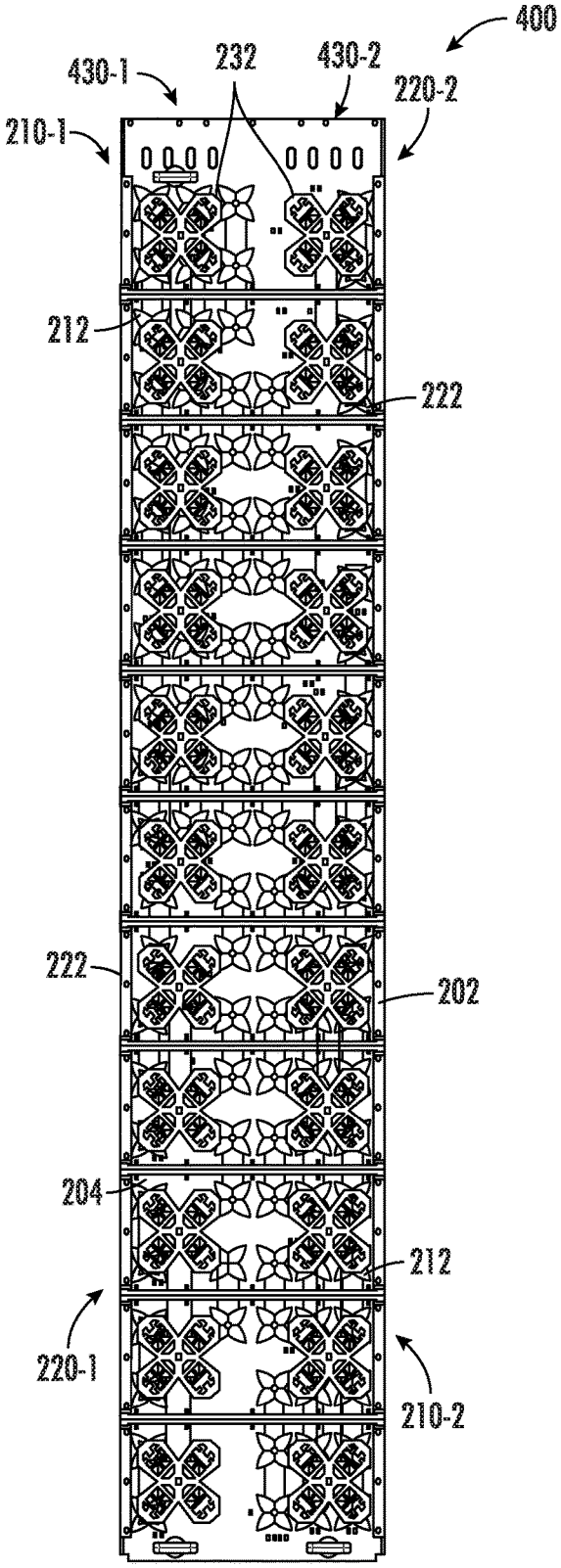

FIG. 4 is a front view of a multiband base station antenna 400 according to further embodiments of the present invention. The base station antenna 400 includes six arrays 210-1, 210-2, 220-1, 220-2, 430-1, 430-2 of radiating elements 212, 222, 232 that are mounted to extend forwardly from a backplane 202. The arrays 210-1, 210-2, 220-1, 220-2 in this embodiment are identical to the correspondingly numbered arrays in the base station antenna 200 of FIG. 2, so further description of these arrays will also be omitted.

Base station antenna 400 differs from base station antenna 200 in that base station antenna 400 includes two arrays 430-1, 430-2 of low-band radiating elements 232 instead of the single array 230-1 of low-band radiating elements 232 included in base station antenna 200. Thus, base station antenna 400 can support operation in an additional low-band frequency band. The arrays 430-1, 430-2 are positioned on left and right sides of the reflector 204 in order to ensure sufficient isolation between the two low-band arrays 430-1, 430-2. In some embodiments, power couplers may be included in base station antenna 400 that are used to couple some of the RF signal energy from the RF ports that are connected to array 430-1 to radiating elements of array 430-2, and vice versa. By coupling some of the RF energy between the arrays 430-1, 430-2 it is possible to reduce the azimuth beamwidth of the antenna beams formed by the arrays 430-1, 430-2, which allows for the use of smaller (and hence lower cost) radiating elements 232. The arrays 430-1, 430-2 may be configured to share RF energy in this way using the techniques disclosed in U.S. Patent Publication No. 2018/0375220, the entire content of which is incorporated herein by reference.

Figure 5:
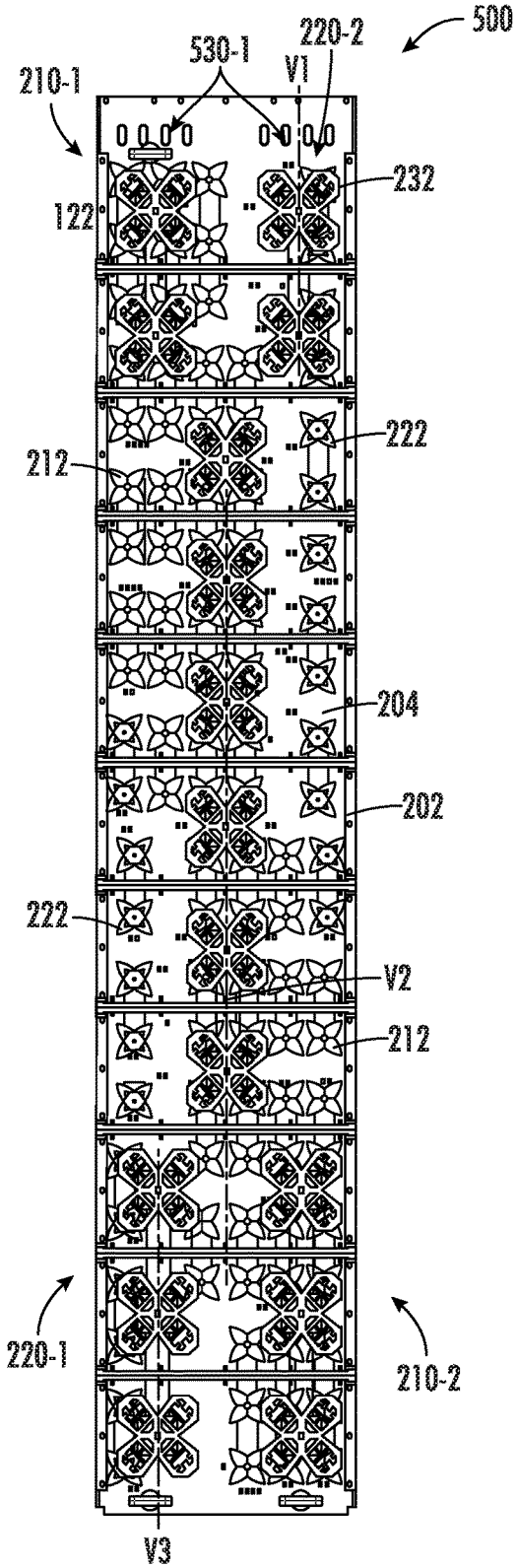

FIG. 5 is a front view of a multiband base station antenna 500 according to further embodiments of the present invention. The base station antenna 500 includes five arrays 210-1, 210-2, 220-1, 220-2, 530-1 of radiating elements 212, 222, 232 that are mounted to extend forwardly from a backplane 202. The arrays 210-1, 210-2, 220-1, 220-2 in this embodiment are identical to the correspondingly numbered arrays in base station antenna 200 of FIG. 2, so further description of these arrays will also be omitted.

Base station antenna 500 differs from base station antenna 200 in that the low-band array 530-1 of antenna 500 includes a total of sixteen radiating elements 232 as opposed to the eleven low-band radiating elements 232 included in base station antenna 200. Six of the low-band radiating elements 232 in array 530-1 extend in a first column down the middle of the reflector 204 along a vertical axis V2. Another five of the low-band radiating elements 232 in array 530-1 extend in a second column down the left side of the reflector 204 along a vertical axis V3. Two of the radiating elements 232 in the second column are located at the top of the reflector 204, while the other three radiating elements 232 in the second column are located at the bottom of the reflector 204. The last five low-band radiating elements 232 in array 530-1 extend in a third column down the right side of the reflector 204 along a vertical axis V2. Two of the radiating elements 232 in the third column are located at the top of the reflector 204, while the other three radiating elements 232 in the third column are located at the bottom of the reflector 204. Each radiating element 232 in the second column is paired with the horizontally adjacent radiating element 232 in the third column. For example, the topmost radiating element 232 in the second column and the topmost radiating element 232 in the third column may each be connected to a first output of the feed network for array 530-1. A power divider may be connected to the first output of the feed network for array 530-1, with a first output of the power divider connected to the topmost radiating element 232 in the second column and a second output of the power divider connected to topmost radiating element 232 in the third column. The other paired radiating elements 232 may be connected to the feed network for array 530-1 in a similar fashion (and each pair may be connected to a different output of the feed network or, more typically, two or more pairs may be connected to the same output of the feed network).

The array 530-1 effectively replaces each of the top two radiating elements 232 and the bottom three radiating elements 232 of array 230-1 with respective pairs of spaced apart radiating elements 232. This acts to narrow the azimuth beamwidth of the antenna beams generated by the array 530-1 as compared to the azimuth beamwidth of the antenna beams generated by the array 230-1, allowing for the use of smaller radiating elements 232 in base station antenna 500.

Figure 6:
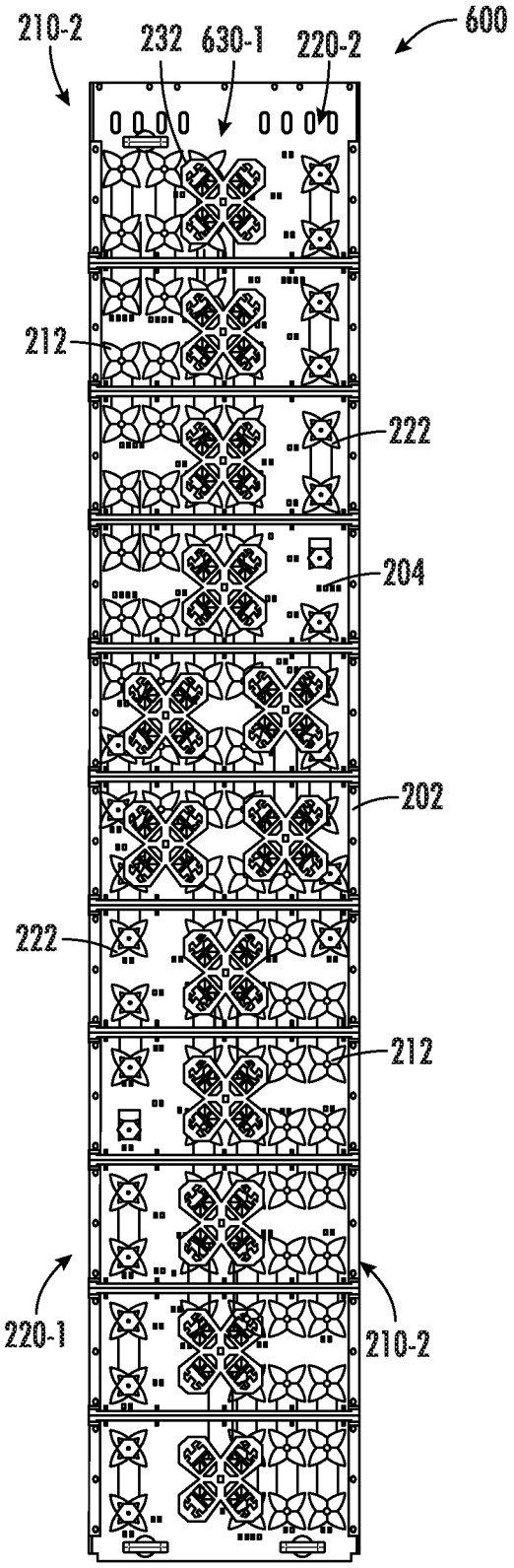

FIG. 6 is a front view of a multiband base station antenna 600 according to still further embodiments of the present invention. The base station antenna 600 includes five arrays 210-1, 210-2, 220-1, 220-2, 630-1 of radiating elements 212, 222, 232 that are mounted to extend forwardly from a backplane 202. The arrays 210-1, 210-2, 220-1, 220-2 in this embodiment are identical to the correspondingly numbered arrays in the base station antenna 200 of FIG. 2, so further description of these arrays will also be omitted.

Base station antenna 600 is similar to base station antenna 500, but differs from base station antenna 500 in that the paired radiating elements 232 are located in the middle of the array 630-1 as opposed to at the top and bottom of the array as is the case with array 530-1. Since the middle radiating elements in an array typically radiate at higher power levels, fewer radiating elements 232 may be required in array 630-1 (as compared to array 530-1) in order to achieve the same reduction in azimuth beamwidth.

Figure 7:
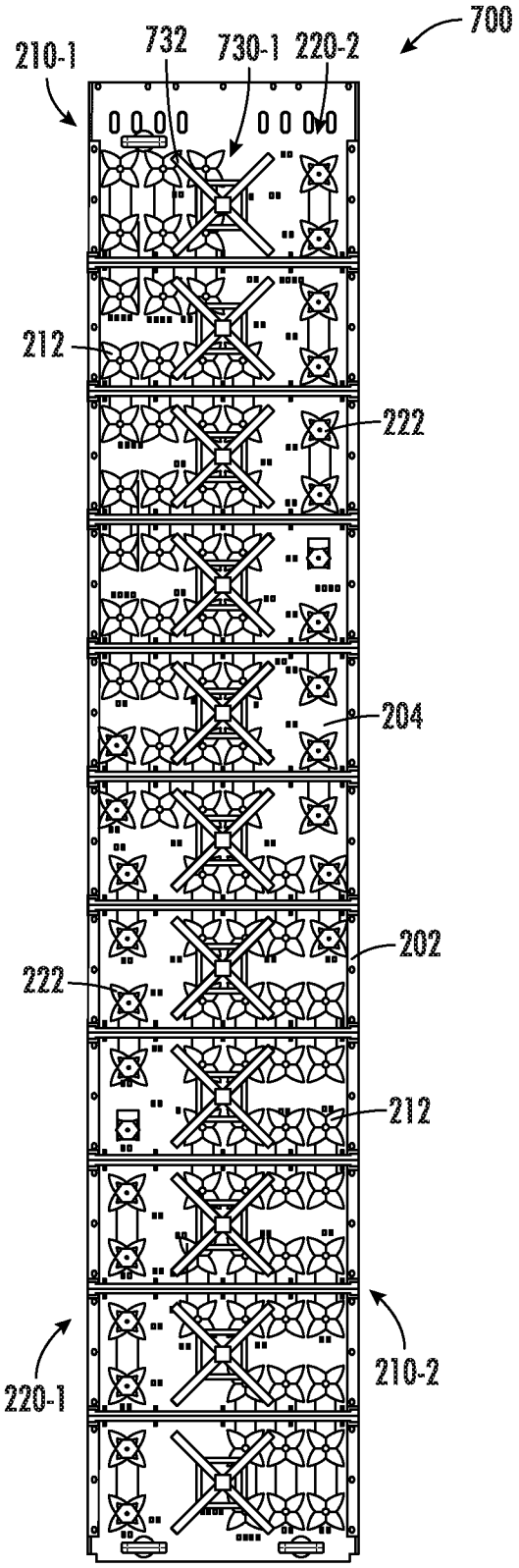

FIG. 7 is a front view of a multiband base station antenna 700 according to still further embodiments of the present invention. The base station antenna 700 includes five arrays 210-1, 210-2, 220-1, 220-2, 730-1 of radiating elements 212, 222, 732 that are mounted to extend forwardly from a backplane 202. The arrays 210-1, 210-2, 220-1, 220-2 in this embodiment are identical to the correspondingly numbered arrays in the base station antenna 200 of FIG. 2, so further description of these arrays will also be omitted.

Base station antenna 700 differs from base station antenna 200 in that the low-band array 730-1 included in base station antenna 700 is implemented using radiating elements 732 that include full wavelength dipole radiators, whereas corresponding array 230-1 of base station antenna 200 is implemented using radiating elements 232 that include half wavelength dipole radiators.

Pursuant to further embodiments of the present invention, multiband base station antennas are provided in which the number of radiating elements included in the high-band linear arrays may be increased (e.g., from eleven radiating elements 122 in the conventional base station antennas 100A-100C of FIGS. 1A-1C to thirteen radiating elements 222) without reducing the number of radiating elements 212 included in the two-dimensional high-band arrays. These multiband base station antennas may exhibit a 7-8% increase in gain for the high-band linear arrays without suffering from any reduction in gain in the two-dimensional high-band arrays, while also providing acceptable levels of isolation between the different high-band arrays.

Figure 8:
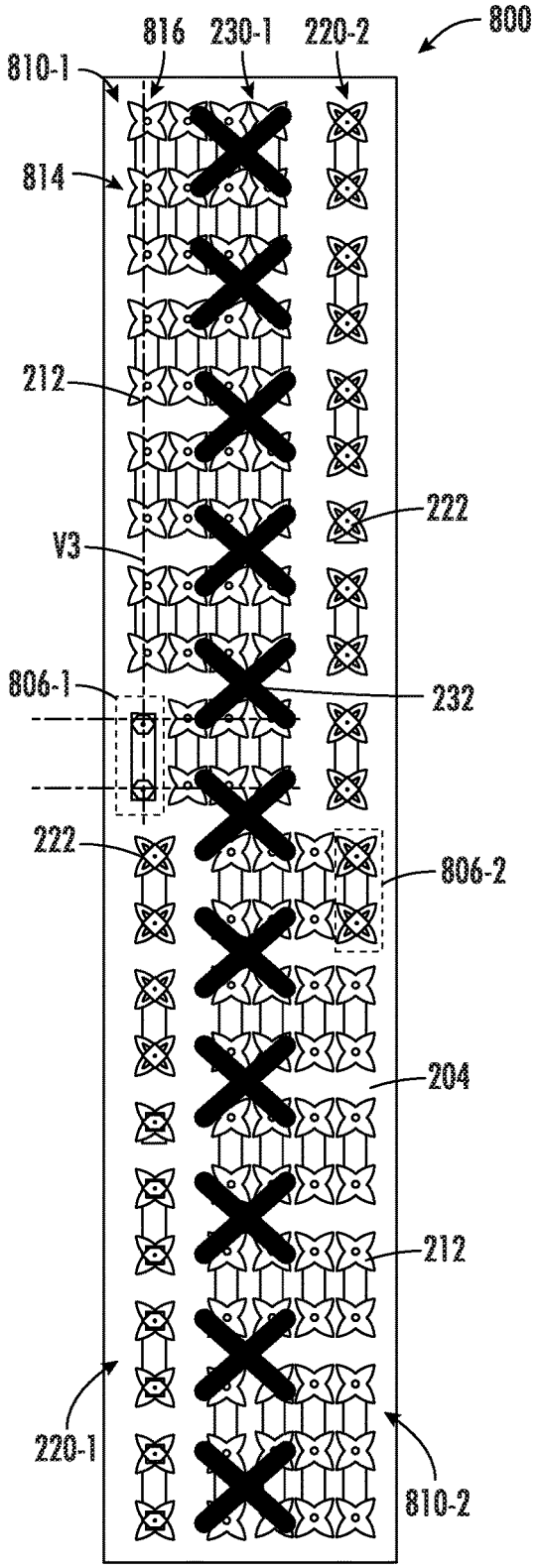

FIG. 8 is a front view of a multiband base station antenna 800 according to embodiments of the present invention. The base station antenna 800 includes five arrays 810-1, 810-2, 220-1, 220-2, 230-1 of radiating elements 212, 222, 232 that are mounted to extend forwardly from a backplane 202. Arrays 220-1, 220-2, 230-1 in this embodiment are identical to the correspondingly numbered arrays in base station antenna 200 of FIG. 2, so further description thereof is omitted here.

Arrays 810-1 and 810-2 are each two-dimensional arrays that include a plurality of horizontally-extending rows 814 and vertically-extending columns 816 of radiating elements 212. In an example embodiment, each radiating element 212 may be configured to operate in the 1695-2400 MHz frequency band. As shown in FIG. 8, some of the rows 814 include three radiating elements 212 while other of the rows 814 include four radiating elements 212. However, in contrast to the array 210-1, 210-2 that are included in base station antenna 200, in base station antenna 800 the rows 814 of arrays 810-1, 810-2 that include three radiating elements 212 are positioned in the middle of the reflector 204 (i.e., at the bottom of array 810-1 and at the top of array 810-2), while the rows 814 that have four radiating elements 212 are located at the top of the antenna 800 (for array 810-1) or at the bottom of the antenna 800 (for array 810-2). Thus, the rows 814 of array 810-1 that include three radiating elements 212 are directly adjacent to the rows 814 of array 810-2 that include three radiating elements 212.

Each array 810-1, 810-2 may be connected to four RF ports (not shown) via a feed network (not shown). The feed network may include beamforming networks that are configured to generate first and second antenna beams (at each of two polarizations) in response to RF signals input at the four RF ports, where each antenna beam is scanned away from the boresight pointing direction of the radiating elements 212 in the azimuth plane so that each array 810-1, 810-2 is configured to operate as a sector splitting array that generates two antenna beams (one at each of two polarizations) that have azimuth half power beamwidths of approximately 27°-33°.

By rearranging where the rows 814 having three radiating elements 212 are located on the reflector 204, a first open area 806-1 is created on the left side of the reflector 204 and a second open area 806-2 is created on the right side of the reflector 204. As described above with reference to base station antenna 200, two extra radiating elements 222 may be positioned in each of these open areas 806 that are part of the single column high-band arrays 220-1 and 220-2 in order to increase the gain of those arrays. Notably, since the rows of the arrays 810 that only include three radiating elements 212 are positioned in the middle of the antenna 800, the open areas 806-1, 806-2 are created without the need to remove any radiating elements 212 from arrays 810-1, 810-2. Thus, base station antenna 800 provides increased gain for arrays 220-1, 220-2 (since each of these arrays includes two additional radiating elements as compared to the conventional base station antennas 100A-100C) while maintaining the gain of arrays 810-1, 810-2.

As shown in FIG. 8, the extra pair of radiating elements 222 that are added to each of arrays 220-1, 220-2 are offset in the horizontal direction from the remaining radiating elements 222 in the respective arrays 220-1, 220-2. In an example embodiment, the additional two radiating elements 222 added to each array 220 are offset in the horizontal direction from the remaining radiating elements 222 in the respective arrays 220-1, 220-2 by between 10-25 mm.

The multiband base station antenna 800 thus includes a first array 810-1 of radiating elements 212, where the radiating elements 212 in the first array 810-1 are arranged in a plurality of vertically-extending columns 816 and a plurality of horizontally-extending rows 814. A lowermost of the horizontally-extending rows 814 includes three radiating elements 212, and at least one of the other horizontally-extending rows 814 includes four radiating elements. The antenna 800 further includes a second array 220-1 of radiating elements 222 that are vertically offset from each other, where a first of the radiating elements 222 in the second array 220-1 is substantially located at an intersection between a first vertical axis that extends along a first (here the leftmost) of the vertically-extending columns 816 of the first array 810-1 and a first horizontal axis that extends along a first of the horizontally-extending rows 814 of the first array 810-1 (here the bottom or next to bottom row 814).

It should also be noted that a lowermost of the horizontally-extending rows 814 of array 810-1 includes a first number (here three) of radiating elements 212, and an uppermost of the other horizontally-extending rows 814 of array 810-1 includes a second number (here four) of radiating elements 212, where the second number is larger than the first number. An uppermost of the horizontally-extending rows 814 of array 810-2 includes the first number (three) of radiating elements 212, and a lowermost of the horizontally-extending rows 814 of array 810-2 includes the second number (four) of radiating elements 212. Array 810-1 is mounted above array 810-2.

Figure 9:
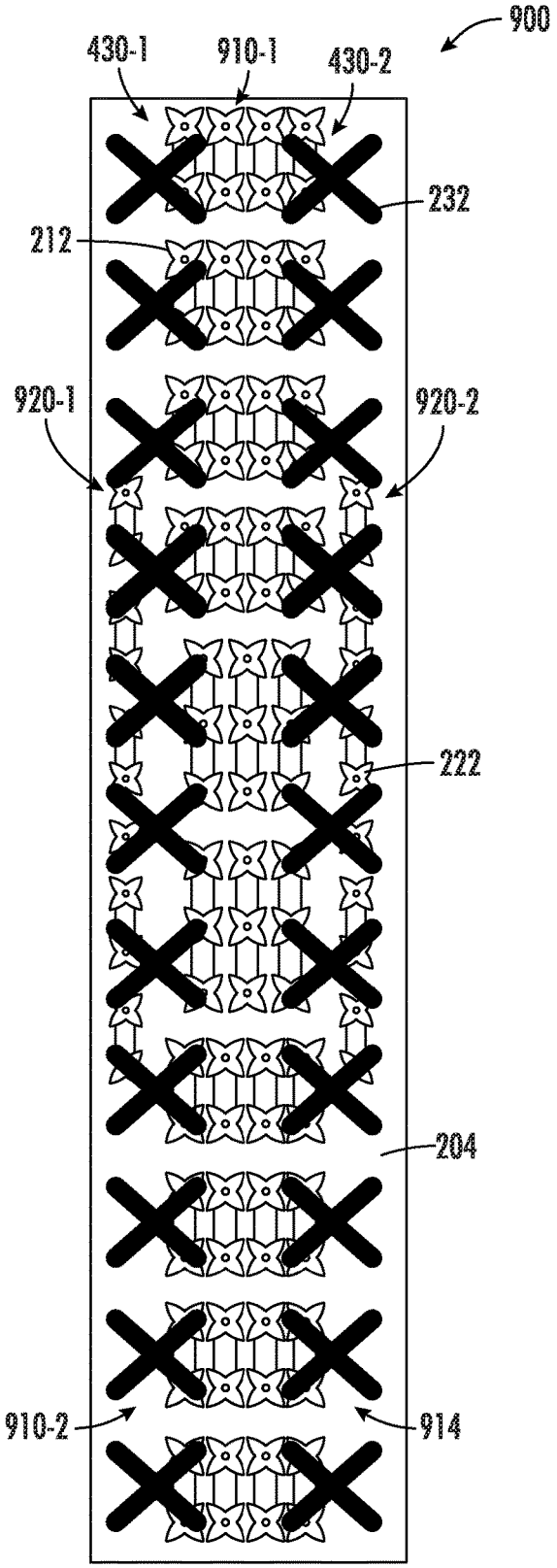

FIG. 9 is a front view of a multiband base station antenna 900 according to embodiments of the present invention. The base station antenna 900 includes six arrays 910-1, 910-2, 920-1, 920-2, 430-1, 430-2 of radiating elements 212, 222, 232 that are mounted to extend forwardly from a backplane 202. Arrays 430-1 and 430-2 in this embodiment are identical to the correspondingly numbered arrays in base station antenna 400 of FIG. 4, so further description thereof is omitted here.

Arrays 910-1 and 910-2 are each two-dimensional arrays that include a plurality of horizontally-extending rows 914 and vertically-extending columns 916 of radiating elements 212. In an example embodiment, each radiating element 212 may be configured to operate in the 1695-2400 MHz frequency band. Arrays 910-1 and 910-2 are very similar to arrays 810-1, 810-2 of base station antenna 800, but in arrays 910-1 and 910-2 the rows 914 that only include three radiating elements 212 are centered on the reflector 204 so that the center radiating element 212 in each row is positioned along a vertical axis that bisects the reflector 204. This approach is also shown in conventional base station antenna 100B of FIG. 1B. As a result, the radiating elements 212 in the rows 914 that only include three radiating elements 212 are not vertically-aligned with any of the radiating elements 212 in the rows 914 that include four radiating elements 212.

Arrays 920-1, 920-2 each comprise a linear array of radiating elements 222 that includes a single vertically-extending column of radiating elements 222. In an example embodiment, each radiating element 222 may be configured to operate in the 1695-2690 MHz frequency band. In another example embodiment, each radiating element 222 may be configured to operate in the 1427-2690 MHz frequency band. Each array 920 includes a total of eleven radiating elements 222 in the depicted embodiment. Array 920-1 is mounted on reflector 204 adjacent array 910-1, close to the left side of the reflector 204, and array 920-2 is mounted on reflector 204 adjacent array 910-2, close to the right side of the reflector 204.

It will be appreciated that the present specification only describes a few example embodiments of the present invention and that the techniques described herein have applicability beyond the example embodiments described above.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Herein a plurality of elements are "vertically aligned" if all of the elements are aligned along a vertically-extending axis. Likewise, a plurality of elements are "horizontally aligned" if all of the elements are aligned along a horizontally-extending axis. Herein elements are considered to be "vertically offset from each other if they are at different heights in a vertical direction. Similarly, elements are considered to be "horizontally offset" from each other if they are at different positions along a horizontal axis (regardless of vertical position). Herein a first element is considered to be "horizontally adjacent" to a second element if the first and second elements are located on a common horizontally-extending axis and are in close proximity to each other with no elements of the same type disposed therebetween.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A multiband base station antenna, comprising:

a backplane;

a first array that includes a plurality of radiating elements that are mounted to extend forwardly from the backplane, the radiating elements in the first array arranged in a plurality of vertically-extending columns and a plurality of horizontally-extending rows, where a lowermost of the horizontally-extending rows of the first array includes a first number of radiating elements, and at least one of the other horizontally-extending rows of the first array includes a second number of radiating elements, where the second number is larger than the first number; and a second array that includes a plurality of radiating elements that are mounted to extend forwardly from the backplane and that are vertically offset from each other, wherein a first of the radiating elements in the second array is substantially located at an intersection between a first vertical axis that extends along a first of the vertically-extending columns of the first array and a first horizontal axis that extends along a first of the horizontally-extending rows of the first array.

2. The multiband base station antenna of claim 1, wherein the first array is configured to operate in a first frequency band and the second array is configured to operate in a second frequency band that only partially overlaps with the first frequency band.

3. The multiband base station antenna of claim 2, wherein a second of the radiating elements in the second array is substantially located at an intersection between the first vertical axis and a second horizontal axis that extends along the lowermost of the horizontally-extending rows of the first array.

4. The multiband base station antenna of claim 3, wherein the first and second radiating elements in the second array are the two uppermost radiating elements in the second array.

5. The multiband base station antenna of claim 4, wherein the first of the horizontally-extending rows of the first array is next to the lowermost of the horizontally-extending rows of the first array.

6. The multiband base station antenna of claim 4, wherein the first and second radiating elements of the second array are substantially vertically aligned with a leftmost of the vertically-extending columns of the first array.

7. The multiband base station antenna of claim 2, wherein the two uppermost radiating elements of the second array are horizontally offset from at least some of the remaining radiating elements of the second array.

8. The multiband base station antenna of claim 2, wherein a leftmost of the vertically-extending columns of the first array has fewer radiating elements than does at least one of the other vertically-extending columns of the first array.

9. The multiband base station antenna of claim 2, wherein an uppermost of the radiating elements in the second array is horizontally adjacent a first of the radiating elements in the first array.

10. The multiband base station antenna of claim 9, wherein a second of the radiating elements in the second array is horizontally adjacent a second of the radiating elements in the first array.

11. The multiband base station antenna of claim 10, wherein the first and second of the radiating elements in the second array are substantially vertically aligned with the leftmost of the vertically-extending columns of the first array.

12. The multiband base station antenna of claim 11, wherein the first and second of the radiating elements in the second array are horizontally offset from at least some of the other radiating elements in the second array.

13. The multiband base station antenna of claim 2, wherein all of the horizontally-extending rows of the first array that have the first number of radiating elements are closer to a center of the backplane than are all of the horizontally-extending rows of the first array that have the second number of radiating elements.

14. The multiband base station antenna of claim 1, further comprising:

a third array that includes a plurality of radiating elements that are mounted to extend forwardly from the backplane, the radiating elements in the third array arranged in a plurality of vertically-extending columns and a plurality of horizontally-extending rows, where an uppermost of the horizontally-extending rows of the third array includes the first number of radiating elements, and at least one of the other horizontally-extending rows of the third array includes the second number of radiating elements; and a fourth array that includes a plurality of radiating elements that are mounted to extend forwardly from the backplane and that are vertically offset from each other, wherein a first of the radiating elements in the fourth array is substantially located at an intersection between a second vertical axis that extends along a first of the vertically-extending columns of the third array and a first horizontal axis that extends along a first of the horizontally-extending rows of the third array.

15. The multiband base station antenna of claim 14, wherein the first array is horizontally spaced apart from the fourth array, and the second array is horizontally spaced apart from the third array.

16. A multiband base station antenna, comprising:

a backplane;

a first array that includes a plurality of radiating elements that are mounted to extend forwardly from the backplane, the radiating elements in the first array arranged in a plurality of vertically-extending columns and a plurality of horizontally-extending rows, where a lowermost of the horizontally-extending rows of the first array includes a first number of radiating elements, and an uppermost of the other horizontally-extending rows of the first array includes a second number of radiating elements, where the second number is larger than the first number; and a third array that is mounted below the first array, the third array including a plurality of radiating elements that are mounted to extend forwardly from the backplane, the radiating elements in the third array arranged in a plurality of vertically-extending columns and a plurality of horizontally-extending rows, where an uppermost of the horizontally-extending rows of the third array includes the first number of radiating elements, and a lowermost of the horizontally-extending rows of the third array includes the second number of radiating elements.

17. The multiband base station antenna of claim 16, further comprising:

a second array that includes a plurality of radiating elements that are mounted to extend forwardly from the backplane and that are vertically offset from each other; and wherein a first of the radiating elements in the second array is substantially located at an intersection between a first vertical axis that extends along a first of the vertically-extending columns of the first array and a first horizontal axis that extends along a first of the horizontally-extending rows of the first array.

18. The multiband base station antenna of claim 17, further comprising:

a fourth array that includes a plurality of radiating elements that are mounted to extend forwardly from the backplane and that are vertically offset from each other, wherein a first of the radiating elements in the fourth array is substantially located at an intersection between a second vertical axis that extends along a first of the vertically-extending columns of the third array and a second horizontal axis that extends along a first of the horizontally-extending rows of the third array.

19. The multiband base station antenna of claim 18, wherein the first array is horizontally spaced apart from the fourth array, and the second array is horizontally spaced apart from the third array.

20. The multiband base station antenna of claim 18, wherein the first and third arrays are configured to operate in a first frequency band and the second and fourth arrays are configured to operate in a second frequency band that only partially overlaps with the first frequency band.

* * * * *